United States Patent [19]

Frangos

[11] 3,935,958

[45] Feb. 3, 1976

[54] UTENSIL BASKET FOR INSTITUTIONAL DISHWASHING MACHINES

[76] Inventor: John W. Frangos, Beverly, Mass. 01915

[22] Filed: Dec. 17, 1973

[21] Appl. No.: 425,237

[52] U.S. Cl. ..... 220/19; 49/267; 134/84; 206/511; 206/513; 220/251; 220/324; 292/300

[51] Int. Cl.² ..... B65D 7/20

[58] Field of Search ..... 220/20, 29, 19, 55 R, 94 A; 206/511, 513; 49/254, 255, 266, 267; 292/300; 134/158, 92, 84; 211/41

[56] References Cited

UNITED STATES PATENTS

| | | | |
|---|---|---|---|
| 1,177,115 | 3/1916 | Klenk | 206/511 |
| 1,205,769 | 11/1916 | McGill | 220/19 |
| 1,601,168 | 9/1926 | Felten et al. | 220/19 |
| 2,822,041 | 2/1958 | Blankenship | 49/254 |
| 3,025,864 | 3/1962 | Ensign | 220/19 |
| 3,419,175 | 12/1968 | Laughlin et al. | 220/19 |
| 3,459,327 | 8/1969 | Harris | 220/20 |
| 3,767,167 | 10/1973 | Rasmussen | 292/300 |

FOREIGN PATENTS OR APPLICATIONS

| | | | |
|---|---|---|---|
| 690,588 | 4/1953 | United Kingdom | 206/513 |
| 41,391 | 1/1933 | France | 220/19 |
| 734,143 | 10/1932 | France | 220/19 |

*Primary Examiner*—William Price
*Assistant Examiner*—Joseph M. Moy
*Attorney, Agent, or Firm*—Morse, Altman, Oates & Bello

[57] ABSTRACT

A foraminous basket is provided for use in washing and drying eating utensils in large volume dishwashers such as found in restaurants, institutions and the like. The basket is formed with a plurality of compartments for sorting the utensils prior to washing. Hinged covers are provided for closing the compartments and a handle is furnished on the covers for lifting the basket from a horizontal loading position to an upright washing position. Legs are provided for drainage purposes and for handle clearance when baskets are stacked on one another.

6 Claims, 5 Drawing Figures

UTENSIL BASKET FOR INSTITUTIONAL DISHWASHING MACHINES

BACKGROUND OF THE INVENTION

1. Field of the Invention

This invention relates generally to dishwashing equipment and more particularly is directed towards a portable basket for pre-soaking and washing eating utensils in an institutional dishwashing machine.

2. Description of the Prior Art

Large volume dishwashing machines of the sort employed by restaurants, institutions and other eating facilities, usually involve a conveyor which carries dishes, pots, pans, utensils, etc., through various washing and drying stages on a continuous or batch basis. While the washing of dishes and similar large objects is generally satisfactory, the washing and handling of eating utensils heretofore has certain disadvantages. In practice, washing machines of this type are provided with a number of simple openwork baskets of plastic, stainless steel mesh or the like in which the utensils are placed in a somewhat random fashion. The baskets are usually carried through the machine in a horizontal position and, when they have gone through a washing and drying cycle, the utensils are picked individually from the basket and placed in separate receptacles ready for use. This practice and associated equipment has several drawbacks. First of all, simple shallow baskets do not support the utensils in a way that insures complete washing and drying of the utensils, particularly if a large number of utensils are in the basket. Secondly, if the utensils have been placed in the basket in a random fashion and subsequently sorted after having been cleaned, excessive handling of the utensils occurs when they are sorted. This, of course, is not desirable from the standpoint of cleanliness and is also time consumming.

Accordingly, it is an object of the present invention to provide a new and improved basket for washing eating utensils in institutional dishwashing machines. Another object of this invention is to provide a utensil basket for large volume dishwashers which provides pre-sorting of the utensils and supports the utensils in an upright position for optimum washing action.

SUMMARY OF THE INVENTION

This invention features a utensil basket for a commercial or institutional dishwasher, comprising a foraminous basket formed with a plurality of adjacent compartments for pre-sorting utensils when the basket is resting in a horizontal open position. Hinged doors are provided on the basket adapted to close the compartments prior to placing the basket in the washing machine. Once the basket is loaded, it is placed in an upright position so that the utensils will be carried vertically through the machine for optimum washing and drying action. Legs on the basket provide clearance with handles on the doors, whereby a number of baskets may be stacked one upon another for storage and transportation.

DETAILED DESCRIPTION OF THE PREFERRED EMBODIMENT

Figure 1:
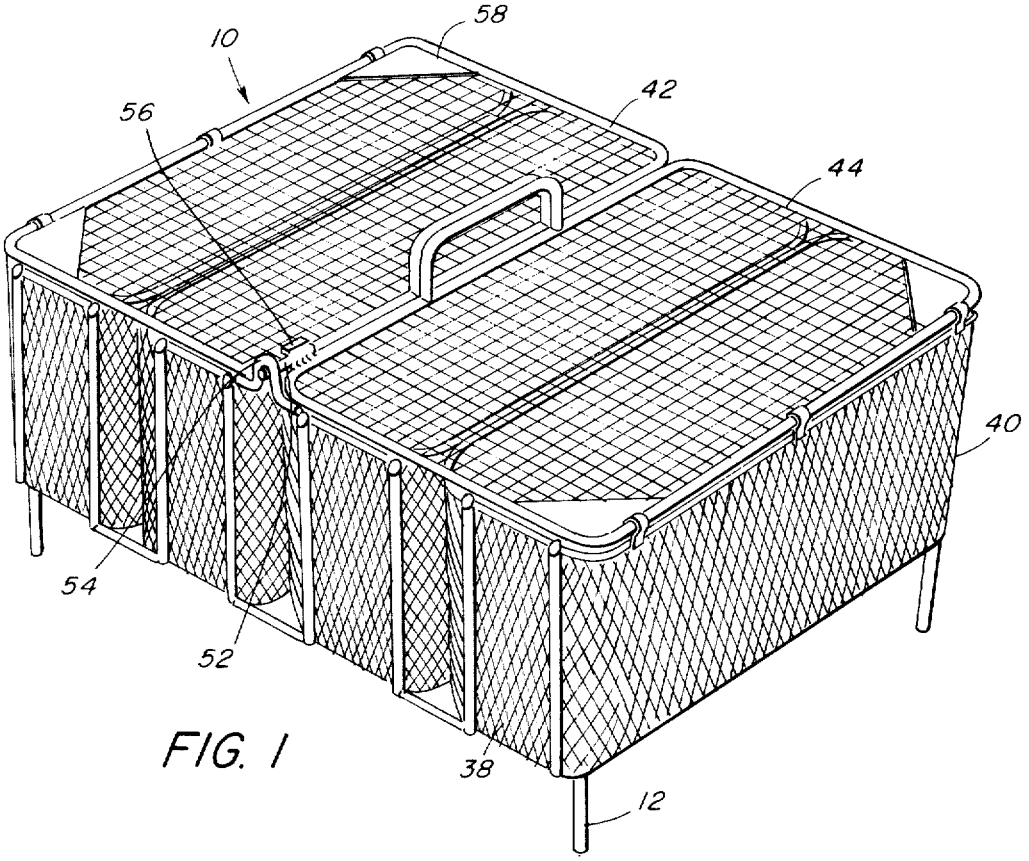
FIG. 1 is a view in perspective of a utensil basket made according to the invention.

Referring now to the drawings, the reference character 10 generally indicates a utensil basket having particular utility in pre-sorting and washing eating utensils in an institutional dishwashing machine. The basket is of openwork construction and may be fabricated from a variety of materials such as stainless steel wire mesh, for example, or it may be molded from a suitable high temperature plastic of foraminous configuration. The basket is portable and typically may be about 16 inches in length, perhaps 10 inches in width with a depth of perhaps 5 inches. Obviously the dimensions are only by way of example and may be varied as desired. The basket is provided with legs 12, one at each corner and of a length of perhaps 1½ inches and together with handles 14 and 16 on the top thereof provide an overall height of perhaps 8½ inches.

Figure 3:
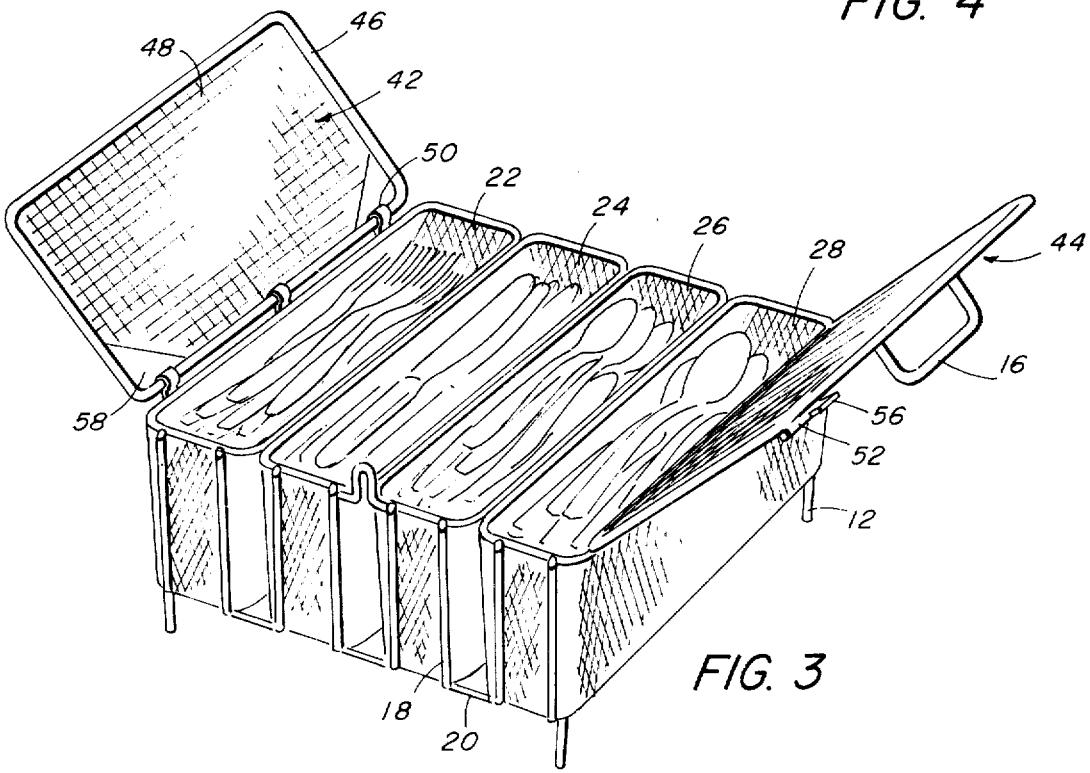
FIG. 3 is a view in perspective showing the basket with the doors open.

In the illustrated embodiment, the basket is fabricated from stainless steel ⅜ inch mesh and includes a frame formed by struts 18 and cross-pieces 20 welded or otherwise joined to the basket. The basket of the illustrated embodiment is formed with four adjacent compartments 22, 24, 26 and 28 adapted to hold, respectively, forks, knives, teaspoons and soup spoons which are sorted by the bus boy, for example, prior to placing the basket in the washing machine. If a greater variety of utensils is being employed obviously the number of compartments may be increased. Each compartment typically is perhaps 4 inches wide and otherwise extends the length and depth of the basket. The compartments are open at their upper ends when the basket is in the horizontal loading position of FIG. 3. Each compartment is formed by side walls 30 and 32 which taper towards a rounded bottom wall 34 to define a wedge-shaped clearance 36 between adjacent compartments. The compartment walls are preferably of the same construction which in the illustrated embodiment is an open mesh stainless steel to allow water jets to pass freely through the basket for maximum washing action. The wedge-shaped clearance between adjacent baskets further enhances the movement of water jets amongst the utensils and also aids in the circulation of drying air during the drying cycle of the machine. The rounded bottom wall 34 facilitates removal of the utensils from the individual compartments after the utensils have been washed and dried.

Figure 4:
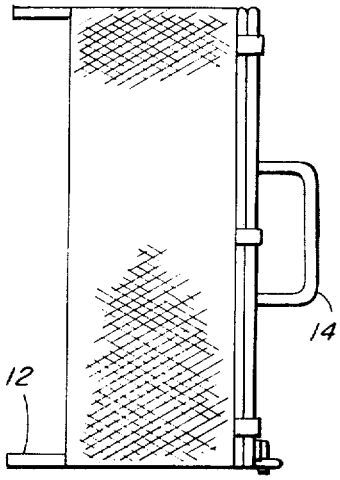
FIG. 4 is a view in side elevation showing the basket in a washing position, and, FIG. 5 is a view in end elevation showing a plurality of stacked baskets.

The compartments are also formed with parallel end walls 38 and 40 which are substantially perpendicular to the open face and back wall of the basket. By forming the end walls 38 and 40 in this fashion, it is possible to stand the basket in the upright position of FIG. 4 for reasons that will presently appear.

Figure 2:
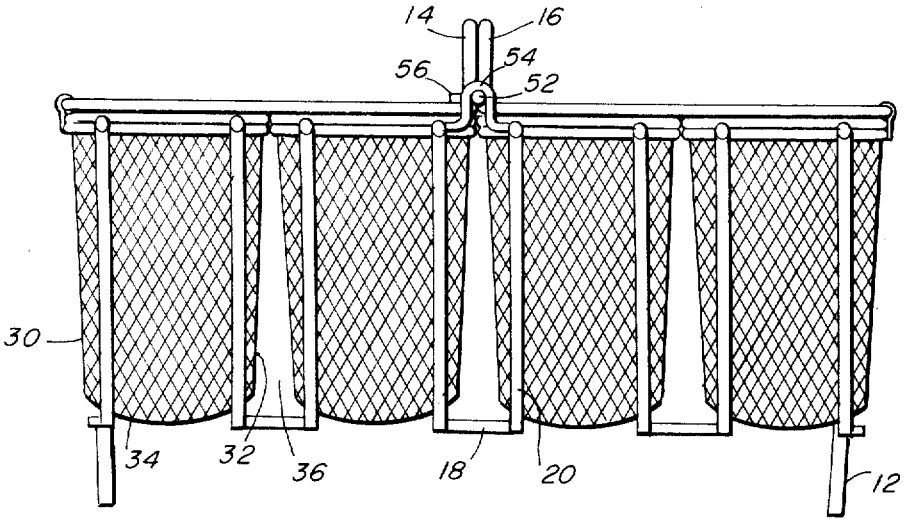
FIG. 2 is a view in end elevation thereof.

The open compartments once loaded are closed by means of a pair of covers or doors 42 and 44 hinged to the end compartments as shown. Each cover typically is dimensioned to span two compartments so that, when closed, they will meet in the middle to fully close the basket and prevent utensils from falling out when the basket subequently is stood in the upright position of FIG. 4. The doors in the illustrated embodiments are formed by rectangular frames 46 to which is attached an openwork mesh panel 48 through which jets of water may freely pass. The frames 46 are attached to the body of the basket by means of a plurality of eyes 50 attached along the upper outer edge of the end compartments. Each of the covers is provided with a handle 14 and 16 which come together in adjacent relation when the covers are closed, as best shown in FIGS. 1 and 2. The handles are provided to permit the operator, bus boy, waitress, or the like, to pick up the entire basket either to set it on edge as in FIG. 4 when the basket is being delivered into a dishwasher or to transfer the basket to a waitress's station or other location once the utensils have been cleaned.

In the illustrated embodiment, the right-hand cover 44 is free to slide perhaps ½ inch in its hinged eyes 50 in order to lock and unlock the covers. The locking mechanism is comprised of a lug 52 located at the corner of the cover 44 along the handle edge thereof. The lug 52 is adapted to engage a loop 54 formed along the top center edge of the basket and projecting slightly above the open side of the basket, as shown. The lug 52 is also provided with a shoulder or lip 56 which extends over the upper edge of the cover 42 which is closed prior to the cover 44 in order that the locking of one cover will at the same time lock the other cover. The cover is locked by sliding the right-hand cover 44 transversely for ½ inch and swinging it down shut against the top of the compartments and against the previously closed cover 42. The cover 44 then is slid in the opposite direction to engage the lug through the loop effectively locking both covers in closed position. The covers are opened by reversing these steps.

Figure 5:
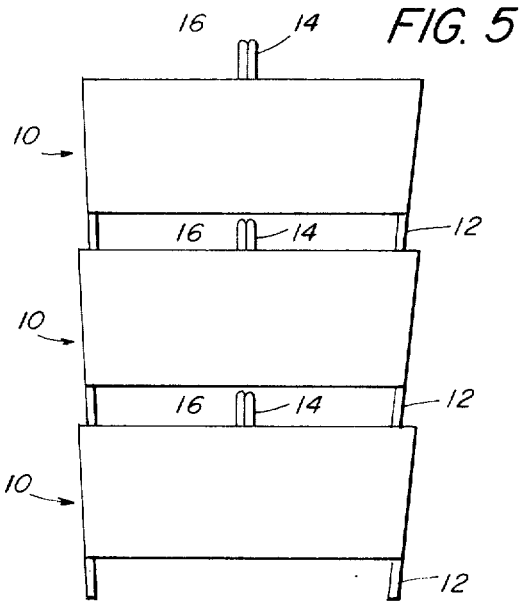

It will also be noted in FIG. 1 that the covers 42 and 44 are formed with solid inserts 58 at the outer corners thereof. The function of the solid inserts is to provide support for the legs 12 of other baskets when stacked upon one another as suggested in FIG. 5. In this fashion, a number of baskets may be stacked in order to allow utensils to be transported on carts or trucks, for example. This is particularly useful for catering operations and the like. It will be noted that when the baskets are stacked the legs 12 have sufficient length to provide clearance for the handles of underlying baskets. The legs also serve to maintain the basket in a raised position so that the utensils may drain more readily while resting on a counter, for example, either before or after being passed through a machine.

When the utensils have been pre-sorted and loaded in the compartments, the covers are closed and locked. The basket is then grasped by the handles and tilted into the upright position of FIG. 4. In this position, the utensils are not piled on one another and stand relatively loosely so that jets of water from the washer will produce a better cleaning action than if the utensils were lying flat and on top of one another. The drying action is also improved when the utensils are in the upright position since water will not collect in spoons but rather will drain freely. By providing the legs 12, which are flush with the end walls of the basket, an effectively wider base is provided to stabilize the basket when in the upright position of FIG. 4.

Once the basket has passed entirely through the machine, it is again grasped by the handle and tipped back to its horizontal position. It may then be stacked with other clean utensils or transported to a dispensing station. Once opened, the waitress can pick up individual knives, forks and spoons by the handles in order to maintain an essential sterile condition.

While the invention has been described with particular reference to the illustrated embodiment, numerous modifications will appear to those skilled in the art. For example, in place of the full doors illustrated, the doors may be partial so as to leave open the upper ends of the compartments and in this way, remove further obstructions to the flow of water against the most soiled portions of the utensils. Also, in place of the double cover arrangement, a single, larger cover may be employed. Various locking devices other than that illustrated may also be employed to advantage.

Having thus described the invention, what I claim and desire to obtain by Letters Patent of the United States is:

1. Apparatus for use in washing eating utensils and the like, comprising:

a. a foraminous basket formed with a plurality of adjacent compartments open to one side of said basket for receiving utensils selectively placed therein, b. foraminous cover means connected to said basket for movement from a closed position across said compartments to an open position, and, c. locking means for securing said cover means to said basket, d. said basket being formed with a back wall and at least one side wall substantially perpendicular to one another whereby said basket may be placed on said back wall in a horizontal position for loading and unloading said compartments and in an upright position on said one side wall for washing, e. said cover means including a pair of panels hinged to opposite sides of said basket, one of said panels being free to reciprocate over a limited distance, said one panel being formed with a lug and a lip at the free edge thereof, f. a loop formed in said basket in position to be in adjacent registration with said lug when said one panel is closed, said lug being engageable with said loop by reciprocation of said one panel, said lip extending in front of said other panel to lock said other panel in closed position.

2. Apparatus according to claim 1 wherein said basket includes a plurality of legs extending substantially perpendicularly from said back wall at the corners thereof.

3. Apparatus according to claim 2 wherein said cover means is formed with solid areas at the corners thereof in position to support the legs of another apparatus stacked thereon.

4. Apparatus according to claim 2 wherein at least two of said legs are substantially co-planar with one of said side walls to stabilize said basket when in an upright position.

5. Apparatus according to claim 2 including handle means on the side of said apparatus opposite said back wall said handle means being shorter then the said legs.

6. Apparatus according to claim 1 including handle means on the side of said basket opposite said back wall.

* * * * *